United States Patent [19]

Lackner et al.

[11] Patent Number: 4,683,607

[45] Date of Patent: Aug. 4, 1987

[54] VACUUM CLEANER ACCESSORY BRACKET

[75] Inventors: John R. Lackner, North Ridgeville; William E. Bartasevich, Jr., Kent, both of Ohio

[73] Assignee: The Scott & Fetzer Company, Cleveland, Ohio

[21] Appl. No.: 732,395

[22] Filed: May 9, 1985

[51] Int. Cl.[4] ..... A47L 9/00; A47L 9/32

[52] U.S. Cl. ..... 15/323; 15/410

[58] Field of Search ..... 15/323, 339, 410

[56] References Cited

U.S. PATENT DOCUMENTS

| | | | |
|---|---|---|---|
| 2,046,684 | 7/1936 | Hoover | 15/323 X |
| 3,204,272 | 9/1965 | Greene et al. | 15/323 X |
| 3,600,100 | 8/1971 | Arones | 15/50 R X |
| 4,249,280 | 2/1981 | Goodrich | 15/323 |

*Primary Examiner*—Chris K. Moore

*Attorney, Agent, or Firm*—Pearne, Gordon, McCoy & Granger

[57] ABSTRACT

A bracket for carrying an accessory appliance on an elongate handle of a primary appliance comprises a bracket body which is contoured to fit on the handle in a sleeve-like manner. The bracket body is pivoted to the primary appliance by a pivot pin which also pivotally connects the handle to the primary appliance. The bracket has a pocket which slidably receives and supports one end of the accessory appliance. Means are provided on the bracket for releasably attaching the accessory appliance to the bracket. This attachment means is in the form of resilient snap action detents which engage recessed body portions of the accessory appliance. The bracket holds the accessory appliance in a close parallel relationship to the handle and provides for the convenient removal of the accessory appliance from such held condition and replacement of the accessory appliance in such held condition.

14 Claims, 4 Drawing Figures

VACUUM CLEANER ACCESSORY BRACKET

BACKGROUND OF THE INVENTION

1. Technical Field

The invention relates generally to household cleaning appliances and accessories used with such appliances. More specifically the invention relates to primary cleaner appliances such as vacuum cleaners and apparatus for mounting and attaching an accessory appliance to the primary appliance.

2. Description of the Related Art

A wide variety of accessories and cleaning tools can be used with conventional canister and upright vacuum cleaners. Many types of storage units for the accessories have been developed which can either be attached to the cleaner or used separately.

A particular accessory which has enjoyed commercial success is a hand-held, self-contained cleaner useful for quick vacuum-powered cleaning in situations when a conventional full-sized cleaner is inconvenient or cumbersome. Though typically such accessory cleaners are used remote from the primary cleaner, it is desirable that the accessory cleaner be stored on the primary cleaner for easy access and convenience. Furthermore, by using the primary cleaner as a carrier for the accessory cleaner, the accessory is always readily available whenever its use is required.

U.S. Pat. No. 4,467,493 issued to Buchtel shows an arrangement whereby an accessory cleaner is stored in an upright style primary cleaner. The accessory is nested in a rigid housing which forms a portion of the upright handle. A particular disadvantage of this design is that the rigid housing is an integral part of the handle and cleaner. The primary and accessory cleaners form a unitary system so that if the consumer desires to buy or use only the primary cleaner, a different handle would be required. This requires production and inventorying of two handle designs with resulting inefficient production and sales costs in order to make the hand-held cleaner an optional purchase for the consumer. Also, the housing renders the primary cleaner more unwieldy and heavier whereas vacuum cleaners are usually desired to be lightweight and easy to handle. In situations where the hand held unit will not be used, Buchtel does not allow for removal of the housing. Though the nested accessory can be removed from the housing, the cumbersome housing is still an integral part of the primary cleaner.

SUMMARY OF THE INVENTION

The present invention provides a new and useful bracket for removably mounting a portable accessory cleaning appliance on an elongate handle of a primary cleaning appliance such as an upright vacuum cleaner. According to one aspect of the invention a bracket is contemplated which provides a pocket and is adapted to be removably mounted on the elongated handle of the vacuum cleaner. The pocket slidably receives one end of the accessory appliance and forms a snug fit to support the accessory on the handle.

According to another aspect of the invention a bracket is shown which is contoured to fit in a sleeve like manner on a vacuum cleaner handle and can be mounted on the handle by a sliding engagement therewith. The bracket can also be releasably and pivotally engaged with the handle of the vacuum cleaner, conveniently with a pivot pin also used to pivotally attach the handle to the vacuum cleaner body.

Another aspect of the invention contemplates a combinational arrangement of a primary appliance having an elongate handle, an elongate portative accessory appliance and a bracket for maintaining the accessory appliance with the primary appliance. The accessory appliance is supported by a pocket on the bracket and means are provided for releasably attaching the accessory to the bracket. The bracket is removably mounted on the handle and furthermore can be releasably engaged to the handle. Thus, the primary appliance can be used with or without the accessory appliance and the bracket attached thereto.

Still another aspect of the invention is a simplified means for releasably attaching the accessory appliance to the bracket. The accessory appliance can be conveniently removed from the bracket by simply grasping the accessory, pulling it free from the attachment means, and then sliding it out of the bracket pocket.

These and other aspects of the invention and advances in the art are more fully described and will be clearly understood from the following specification in view of the accompanying drawings.

DESCRIPTION OF THE PREFERRED EMBODIMENT

Figure 1:
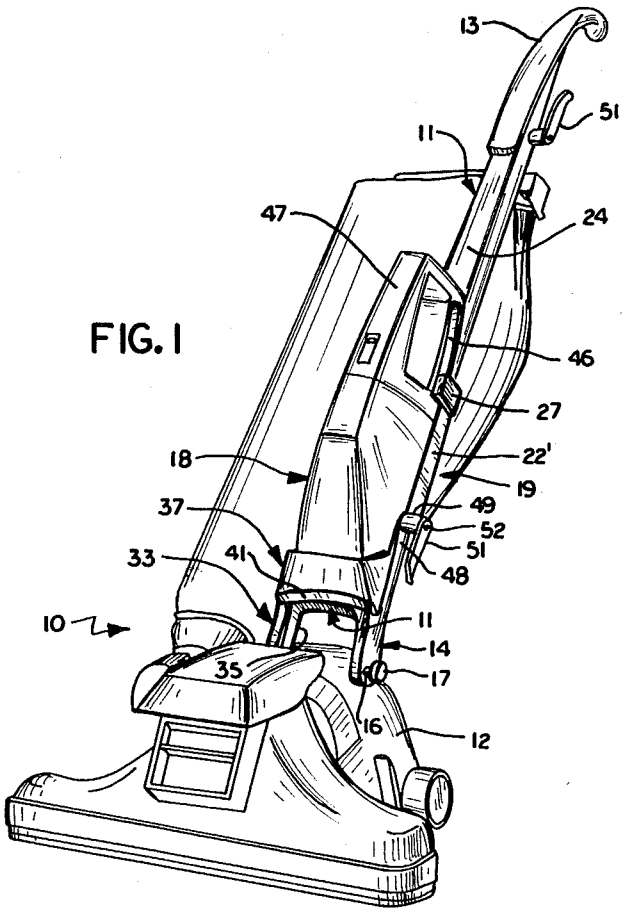
FIG. 1 is a perspective view of the preferred embodiment of the invention.

A combinational arrangement embodying the concepts of the present invention is shown in FIG. 1. A primary floor care appliance 10, such as a conventional upright vacuum cleaner, provides an elongate handle 11 which is pivotally attached at one end to the vacuum cleaner power plant 12. A handgrip 13 is conveniently provided on the free end of the handle 11.

The handle 11 provides a forked end portion 14, opposite the handgrip 13, which is pivotally connected to the power plant 12 by a pivot pin 16. The pivot pin has a knob 17 which can be grasped to pull the pin free thereby releasing the handle 11 from the vacuum cleaner head 12.

The present invention contemplates an elongate accessory appliance 18, which may be in the nature of a hand-held vacuum cleaner, mounted in a close parallel relationship on the elongate handle 11 with a bracket 19. The accessory appliance 18 may be of conventional design and typically is used remotely from the primary cleaner 10.

The bracket 19 is preferably an integrally formed structure having a rigid main body portion 21 which is contoured to the shape of the elongate handle 11 and fits on the handle in a sleeve-like manner. A pair of opposed body sides 22 and 22' extend laterally from a generally planar web 23 and engage the handle 11 on its respective adjacent sides; the web 23 is generally parallel to and abutting an upper surface 24 of the handle 11. The width of the web 23 and correspondingly the lateral spacing between the sides 22 and 22', taper longitudinally to conform to a longitudinally tapered width of the handle 11. The web 23 can be provided with a cut-out portion or window 26 through which the upper surface 24 of the handle 11 can be viewed; this may be useful, for example, for viewing a manufacturer's logo affixed on the handle or other decorative design.

Figure 2:
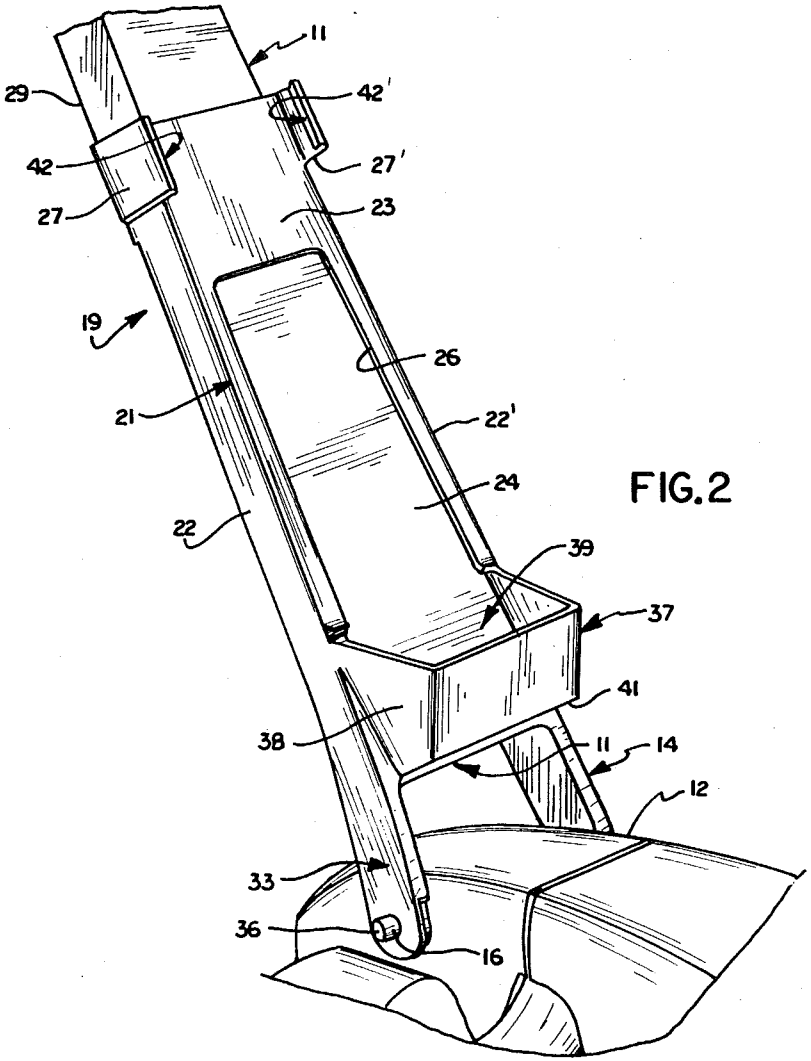
FIG. 2 is an enlarged perspective view of the bracket shown in FIG. 1, the accessory appliance having been omitted for clarity.
Figure 4:
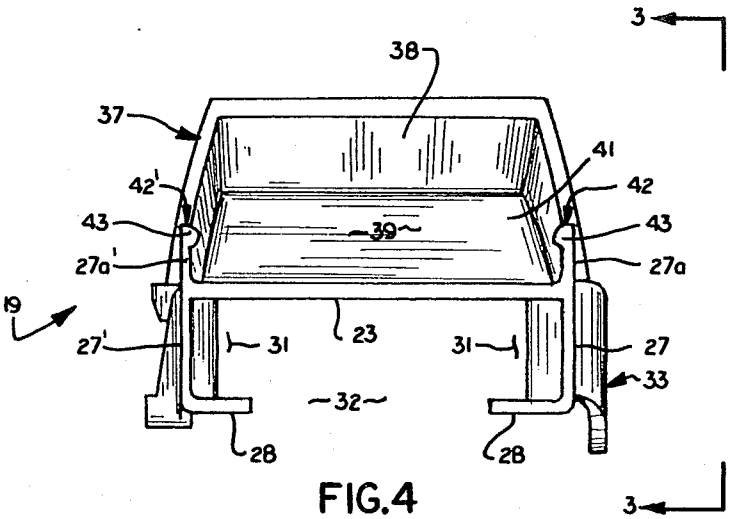
FIG. 4 is an end view of the bracket shown in FIG. 2.
Figure 3:
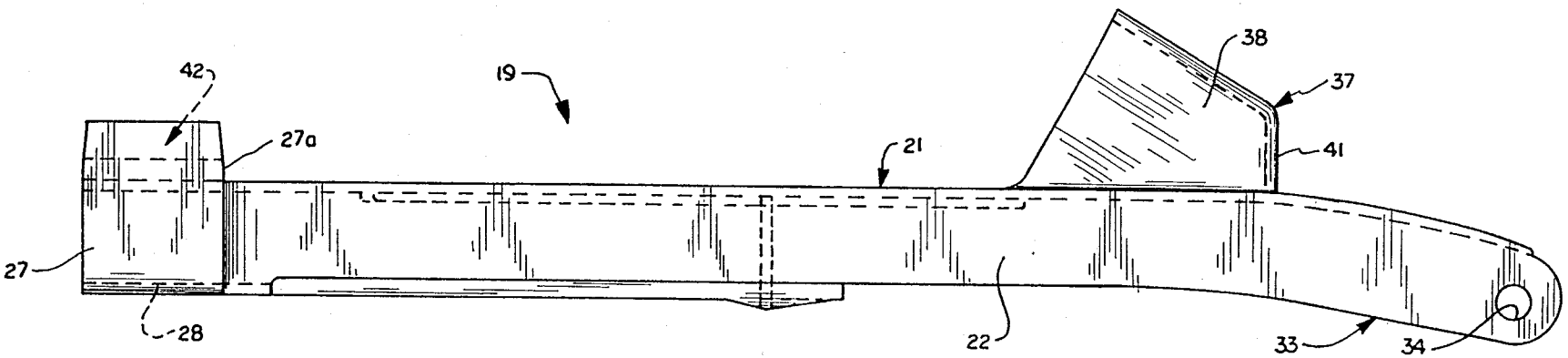
FIG. 3 is a side elevation of the bracket shown in FIG. 2.

As best shown in FIGS. 3 and 4, the sides 22 and 22' have an increased width at one end thereby forming a pair of opposed legs 27 and 27' extending transversely the web 23 on either side thereof. The legs 27 are provided with lateral sleeve members 28 which extend inwardly towards each other and generally parallel to the web 23. The sleeves 28 engage the backside 29 (FIG. 2) of the handle 11 to prevent transverse movement of the bracket 19 and to maintain the bracket 19 with the handle 11. Thus, the handle sides are respectively received in a pair of opposed slots 31 defined by the inner surfaces of the web 23, the legs 27 and the sleeve member 28 which engage or grip the handle 11 for mounting the bracket 19 thereon. The slots 31 also act as a guide for aligning the bracket 19 when it is mounted on the handle 11.

The sleeve members 28 extend longitudinally and engage the handle backside 29 along a sufficient length to ensure a secure mounting of the bracket 19 on the handle 11. Also, the sleeves 28 should be short enough to prevent excessive friction between the perimeter surfaces of the slots 31 and the sides of the handle 11. In the preferred embodiment, a bracket having an overall length of about 13 inches is provided with sleeves 28 being about 1.5 inches in length.

It should now be clear that the bracket 19 can be removably mounted in a sleeve-like manner on the handle 11 by a simple sliding or slip-on engagement therewith. The bracket is placed on the handle towards its free end where the tapered handle width is about less than the lateral space 32 between the sleeves 28. The bracket 19 can then be easily slid down and over the handle 11 as a sleeve towards the pivoted forked end 14.

Referring to FIGS. 2 and 3, one of the bracket body sides 22 is longitudinally longer than the other side and forms an attachment arm 33 which engages a portion 35 of the handle forked end 14. A through hole 34 is provided in the arm 33 and receives a distal end 36 of the pivot pin 16. This permits the pin 16 to pass beyond the side 22 and hinge the bracket 19 to the vacuum cleaner 10. The rigid integral nature of the bracket 19 prevents the arm 33 from slipping off the pivot pin distal end 36. Thus, the bracket 19 is releasably and pivotally engaged with the handle 11 and the primary appliance 10 as well as removably mounted in a sleeve-like manner on the handle 11. The hinged engagement between the bracket 19 and the power plant 12 prevents axial sliding movement of the bracket 19 along the handle 11 while at the same time permitting the bracket to pivotally move with the handle with respect to the appliance 10. This allows the frictional engagement between the slots 31 and the sides of the handle 11 to be minimized by appropriate sizing and contouring of the bracket 19 to the shape of the handle 11.

A rigid pocket 37 is provided on the bracket 11 and is integrally formed therewith. As shown in FIG. 2, the pocket 37 is in the nature of an open-top receptacle or pouch formed by a web 38. The web 38 defines an opening 39 suitably sized to slidably receive one end of the accessory appliance 18, as shown in FIG. 1. The web 28 provides a floor portion 41 which supports the snout of the accessory appliance 18. Thus, the pocket 37 supports the accessory appliance 18 on the bracket 19 by substantially surrounding, with preferably a snug fit, one end of the accessory appliance. The pocket web 38 also acts as a protective casing to prevent damage to the accessory appliance snout.

Referring to FIGS. 2 and 4 and as previously described, the legs 27 and 27' located on the end of the bracket body 21 opposite the pocket 37 extend transverse the web 23. The leg portions **27*a* and 27*a'* which extend from the same side of the web 23 as the pocket 37 carry in a cantilever fashion a pair of longitudinal locking ribs 42 and 42'. The ribs 42 and 42' extend the entire length of the legs 27. Each rib 42 is formed by a rounded portion of increased web thickness 43 along the top of its respective leg 27*a*. The relatively reduced web thickness of the legs 27*a* permits a resilient movement of the ribs 42 away from each other as by a cantilever type bending of the legs 27*a***.

The ribs 42 and 42' cooperate with complementary recesses 46 located longitudinally along both sides of the accessory appliance 18. The ribs 42 with the corresponding recesses 46 in the necessory appliance act as snap action detents and are appropriately sized to form a snap-fit retention of the accessory appliance 18 on the bracket 19 when the accessory appliance 18 is fully mounted thereon as shown in FIG. 1. The snap-fit arrangement just described provides a convenient means by which the accessory appliance 18 can be releasably attached to the bracket 19 while also being supported and protected by the pocket 37.

From FIG. 3 it can be seen that the pocket 37 opens somewhat outwardly and away from the bracket body 21 for conveninent insertion and removal of the accessory appliance 18. The accessory 18 can be slidably inserted into the pocket 37 at an angle away from the web 23. Once the snout of the appliance 18 is seated in the pocket 37, its rear portion can be snapped into locking engagement with the resilient ribs 42 as described.

To remove the accessory 18, a firm pull on the rear portion of the accessory, for example on the handle 47, will release the accesory from the ribs 42 attachment and the appliance 18 can then be backed out of the pocket 37 for use.

As best shown in FIG. 1, the bracket 19 is provided with a slot or recess 48 in one of the sides 22'. The recess 48 receives a mounting stem 49 of a cord hook 51 which is attached to the handle 11 by a threaded screw 52. Thus, the bracket 19 shown can be used to mount an accessory appliance proximate a conventional upright vacuum cleaner handle without any modification of the handle.

The bracket 19 is made of a lightweight and durable material, preferably polypropylene, by any convenient and known methods such as injection molding.

One of the important advantages of the bracket described herein is that is provides a means for removably mounting a portable accessory appliance on an otherwise conventional upright vacuum cleaner handle in a close parallel relationship thereto. The handle does not have to be modified in any way yet the accessory appliance is safely and easily transportable with and by the vacuum cleaner and handle. This also results in an important marketing advantage because the vacuum cleaner can still be sold separately as a conventional appliance. Consequently, the accessory appliance and bracket can be sold as optional accessories for use with the primary appliance without having to later change the primary appliance or detracting from its overall attractive appearance. No housing is required as the bracket fully supports the accessory appliance and the pocket protects the same. This maintains the overall production cost of the primary appliance lower.

Another advantage of the invention is that whenever the user knows that the accessory appliance is not needed for a particular chore, the accessory appliance and bracket can be quickly and easily removed to minimize the weight on the primary appliance. This can ease the burden of the particular chore by maintaining the primary appliance in its original convenient-to-use configuration. Prior primary appliances which have specialized handles for holding the accessory appliance are not suited for frequent modification to a conventional appliance.

The snap-fit detent arrangement acts as a releasable attachment of the accessory appliance to the bracket and provides a simple-to-use yet secure means for carrying the accessory on the primary appliance. The attachment requires a minimum number of parts with no linkages or biasing elements such as springs. Of course, such features could be used within the scope of the present invention but are unnecessarily complex.

Another advantage of the invention is that the sleeve-like nature of the bracket presents a sleek compact appearance and permits simple mounting and removal of the bracket on the handle as well as requiring a minimal amount of material for the bracket. This reduces the production cost of the bracket, particularly when compared to the cost to produce dedicated handles as shown in the prior art. This is especially important because the market for such dedicated handles is usually more limited than for conventional handles.

It is to be appreciated that many modifications to the preferred embodiment are possible without departing from the scope and spirit of the claimed invention. For example, the pocket 37 can be elongated to engage and support a longer portion of the accessory appliance, thus obviating the need for the releasable attachment provided by the cooperating ribs and slots on the bracket and accessory respectively. Also, a tight friction fit between the bracket body and handle can be used in lieu of the hinged engagement of the arm 33 to the primary cleaner heads 12. Furthermore, many types of releasable attachments of the accessory to the bracket are possible.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In combination, a vacuum cleaner having an elongate handle, an elongate accessory cleaner and a bracket, said bracket being adapted for removable mounting on the handle, said bracket including means for securely holding the accessory cleaner proximate the handle, said holding means providing for convenient removal of the accessory cleaner from such held condition and replacement of the accessory cleaner in such held condition, said bracket providing a rigid body portion contoured to the handle and mountable as a sleeve on the handle.

2. The combination of claim 1, wherein said holding means includes a pocket which slidably receives a portion of the accessory cleaner and securely supports the accessory cleaner on the handle for movement therewith.

3. The combination of claim 1, wherein said holding means includes a pocket which slidably receives one end of the accessory cleaner and supports the accessory cleaner, and wherein said bracket and accessory cleaner have cooperating means for holding the accessory cleaner in a close parallel relationship to the handle.

4. The combination of claim 3, wherein said cooperating means provides for a releasable attachment of the accessory cleaner to said bracket.

5. The combination of claim 4, wherein said cooperating means includes resilient members on said bracket which engage with recessed body portions of the accessory cleaner to form a snap-fit attachment of the accessory to the bracket.

6. The combination of claim 1, wherein the handle and said bracket body have complementary tapered widths, said bracket body being removably mounted on the handle with a slip-on engagement.

7. The combination of claim 6, wherein the handle is pivoted to a body portion of the vacuum cleaner by a removable pivot pin, said bracket body having a portion in hinging engagement with said pivot pin.

8. A bracket for securely holding a portative accessory appliance on a primary appliance and for convenient removal from and replacement in such held condition, comprising a bracket body adapted to be removably mounted on an elongate handle of the primary appliance, said bracket body having a rigid pocket for slidably receiving and supporting an end portion of the accessory appliance, and snap action detents on said bracket body which receive and releasably retain the accessory appliance in such held condition, said bracket body being contoured to fit on said primary appliance handle in a sleeve-like manner.

9. A bracket according to claim 8, wherein said snap action detents are resilient rib members which engage recessed body portions of the accessory appliance to maintain the accessory appliance with said bracket and handle.

10. In combination, a primary floor care appliance having an elongate handle, an elongate portable accessory appliance and a bracket, said bracket having a body part in the nature of a sleeve contoured to be removably mounted on the handle, said bracket body having means for securely holding the accessory appliance in a proximate parallel relationship to the handle, said holding means providing for convenient removal of the accessory appliance from said bracket and replacement of the accessory appliance to said bracket.

11. The combination of claim 10, wherein said bracket is removably mounted on the handle with a sliding engagement, and wherein said holding means includes an open-top receptable for slidably receiving one end of the accessory appliance, said accessory appliance and bracket having cooperating means for releasably attaching the accessory appliance to said bracket.

12. In combination, a vacuum cleaner having an elongated handle, an elongated accessory cleaner, and an elongated substantially rigid bracket, said bracket being adapted for removably mounting directly on said handle independently of any other component of the vacuum cleaner and in a fixed position substantially aligned with said handle for support by said handle and for movement with said handle independently of any other component of the vacuum cleaner, said bracket including means for securely holding an accessory cleaner proximate the handle in a fixed position substantially aligned with said handle, said holding means providing for convenient removal of the accessory cleaner from such held position and replacement of the accessory cleaner in such held position.

13. The combination of claim 12 wherein said holding means includes a pocket which slidably receives a portion of the accessory cleaner and securely supports the accessory cleaner on the handle for movement therewith.

14. In the combination of claim 13 snap action detents on said bracket releasably retaining said accessory cleaner in said fixed position aligned with that handle.

* * * * *